US011149936B2

(12) United States Patent
Spiro

(10) Patent No.: US 11,149,936 B2
(45) Date of Patent: Oct. 19, 2021

(54) UNIFORMLY LIT PLANAR FIELD OF ILLUMINATION

(71) Applicant: Daniel S. Spiro, Scottsdale, AZ (US)

(72) Inventor: Daniel S. Spiro, Scottsdale, AZ (US)

(73) Assignee: Exposure Illumination Architects, Inc., Scottsdale, AZ (US)

( * ) Notice: Subject to any disclaimer, the term of this patent is extended or adjusted under 35 U.S.C. 154(b) by 0 days.

(21) Appl. No.: 16/821,792

(22) Filed: Mar. 17, 2020

(65) Prior Publication Data

US 2021/0254820 A1 Aug. 19, 2021

Related U.S. Application Data

(60) Provisional application No. 62/977,994, filed on Feb. 18, 2020.

(51) Int. Cl.

| | |
|---|---|
| ***F21V 29/74*** | (2015.01) |
| ***F21S 9/02*** | (2006.01) |
| ***G09F 13/04*** | (2006.01) |
| ***F21V 33/00*** | (2006.01) |
| ***F21V 21/30*** | (2006.01) |
| ***F21V 14/02*** | (2006.01) |
| ***F21V 21/28*** | (2006.01) |

(52) U.S. Cl.

CPC ..... *F21V 29/745* (2015.01); *F21S 9/024* (2013.01); *F21V 33/0076* (2013.01); *G09F 13/0413* (2013.01); *F21V 14/02* (2013.01); *F21V 21/28* (2013.01); *F21V 21/30* (2013.01); *G09F 13/0436* (2021.05); *G09F 2013/05* (2021.05)

(58) Field of Classification Search

CPC .... F21V 29/745; F21V 33/0076; F21V 14/02; F21V 14/025; F21V 14/06; F21V 14/065; F21V 21/26; F21V 21/28; F21V 21/30; F21V 29/73; F21S 9/024; F21S 9/022; G09F 2013/0459; F21Y 2107/50

See application file for complete search history.

(56) References Cited

U.S. PATENT DOCUMENTS

| | | | | |
|---|---|---|---|---|
| 3,772,527 | A * | 11/1973 | Darling | F21V 21/02 307/66 |
| 5,101,326 | A * | 3/1992 | Roney | B60Q 1/2615 362/545 |
| 5,647,661 | A * | 7/1997 | Gordin | F21V 7/18 362/283 |
| 5,797,673 | A * | 8/1998 | Logan | G09F 13/04 362/20 |
| 6,431,728 | B1 * | 8/2002 | Fredericks | |
| 6,578,979 | B2 * | 6/2003 | Truttmann | |
| 6,606,808 | B2 * | 8/2003 | Katz | G09F 13/04 362/234 |
| 7,654,691 | B2 * | 2/2010 | Liu | F21V 29/713 362/249.02 |
| 7,758,211 | B2 * | 7/2010 | Zheng | F21V 29/89 362/249.02 |

(Continued)

*Primary Examiner* — Jong-Suk (James) Lee
*Assistant Examiner* — James M Endo
(74) *Attorney, Agent, or Firm* — Barnes & Thornburg LLP; Irina N. Sullivan; Michael A. Carrillo

(57) ABSTRACT

A light emitting embodiment uniformly illuminating a planar field configured to operate in conjunction with other like embodiments in proximity to form a continuous uniformly lit planar pathway and/or field of illumination.

20 Claims, 10 Drawing Sheets

(56) References Cited

U.S. PATENT DOCUMENTS 7,926,974 B2 * 4/2011 Wung ..... F21V 29/763 362/237
2002/0020816 A1 * 2/2002 Leen ..... F21V 17/02 250/342
2004/0026706 A1 * 2/2004 Bogner ..... F21V 5/04 257/99
2004/0062055 A1 * 4/2004 Rozenberg ..... G08B 7/066 362/555
2008/0037257 A1 * 2/2008 Bolta ..... F21S 4/28 362/294
2008/0062689 A1 * 3/2008 Villard ..... F21V 19/02 362/249.07
2008/0224849 A1 * 9/2008 Sirhan ..... F21V 23/0442 340/521
2008/0232102 A1 * 9/2008 Martineau ..... F21V 7/04 362/235
2009/0034257 A1 * 2/2009 Liu ..... F21V 29/75 362/249.14
2009/0141494 A1 * 6/2009 Zhang ..... F21V 29/74 362/249.03
2009/0154172 A1 * 6/2009 Zheng ..... F21V 29/75 362/373
2009/0168418 A1 * 7/2009 Zheng ..... F21V 29/76 362/234
2009/0185374 A1 * 7/2009 Wu ..... F21S 8/086 362/249.06
2009/0310330 A1 * 12/2009 Vann ..... F21S 9/022 362/20
2010/0188849 A1 * 7/2010 Luo ..... F21K 9/00 362/249.02
2011/0002119 A1 * 1/2011 Huang ..... F21V 29/76 362/249.02
2011/0017441 A1 * 1/2011 Shin ..... F21V 29/76 165/185
2011/0026253 A1 * 2/2011 Gill ..... F21V 19/001 362/249.02
2011/0103037 A1 * 5/2011 Liu ..... F21V 21/30 362/20
2011/0232143 A1 * 9/2011 Hsu ..... G09F 13/18 40/570
2013/0107530 A1 * 5/2013 Wyrick ..... A01G 9/26 362/249.02
2014/0085909 A1 * 3/2014 Ahn ..... F16M 11/10 362/382
2014/0218922 A1 * 8/2014 Kim ..... F21S 8/086 362/249.02
2014/0265874 A1 * 9/2014 Marquardt ..... H05B 47/185 315/153
2014/0331533 A1 * 11/2014 Hasan ..... G08B 7/062 40/570
2016/0123564 A1 * 5/2016 Quilici ..... H05B 45/00 362/233
2016/0148472 A1 * 5/2016 Hsu ..... G08B 5/36 362/231
2016/0341378 A1 * 11/2016 Donners ..... F21S 8/086
2017/0066364 A1 * 3/2017 Ruat ..... F21S 43/145
2017/0248296 A1 * 8/2017 Sekowski ..... F21V 21/30
2017/0270836 A1 * 9/2017 Kim ..... G08B 7/062
2017/0299151 A1 * 10/2017 Luo ..... F21K 9/237
2018/0073696 A1 * 3/2018 Cyr ..... F21S 9/024
2018/0192502 A1 * 7/2018 Lozano ..... F21S 9/022

* cited by examiner

UNIFORMLY LIT PLANAR FIELD OF ILLUMINATION

CROSS REFERENCE TO RELATED APPLICATION[S]

This application claims priority to U.S. Provisional Patent Application entitled "EGRESS LIGHT," Ser. No. 62/977,994, filed Feb. 18, 2020, the disclosure of which are hereby incorporated entirely herein by reference.

BACKGROUND OF THE INVENTION

National and local building codes mandate the use of egress lighting luminaires in buildings occupied by humans. The egress lighting luminaires conforming to code requirements generate an illuminated "legal path of egress". This path of egress enables building occupants to find their way out of the building in the event of main building power outage. In such an event, the building egress lighting is turned on, forming a continuous path of egress to the building's "legal exit doors". Some jurisdictions also require illumination of a path of egress at the exterior side of the legal exit doors.

The egress lighting luminaires are commonly powered by one of the following means: A. Integral battery; B. Remote inverter; C. Fuel cell; and D. Generator. A sensing device continuously monitors the presence of house line power. When the power is interrupted, a transfer switch transfers the power to the emergency back-up power, thus activating the egress lighting luminaires.

Today, the lighting industry in North America can be divided into the following categories as they pertain to egress illumination: A. An emergency lighting manufacturing company; B. A lighting conglomerate with a division that manufactures emergency lighting, also employing emergency lighting components with other divisions' lighting products; and C. A lighting manufacturing company employing egress lighting components manufactured by others. As a result, there are no standards for luminaires and light sources' form other than what is required by code/s. When it comes to lamp source, drivers and batteries, the manufacturers prefer using off the shelf products typically fabricated by others, often having no knowledge of their components' ultimate purpose.

New technologies and production means and methods today will soon render many of the conventional egress lighting embodiments obsolete. The present innovation employs the emergent technologies showing how such technologies can be incorporated into the art of egress lighting technology as well as other non-emergency lighting applications having similar illumination needs.

SUMMARY OF THE INVENTION

The present innovation relates to an illumination solution that forms a continuous and uniform illuminated path. The path width, illumination light levels and uniformity ratios can be maintained regardless of the building's ceiling height. The solution light source embodiment's features include:

- An embodiment that can stand alone or can be incorporated with other electrified egress and non-egress lighting devices.
- An embodiment that is suitable for use indoors and outdoors.

- An embodiment that can have an integral and/or remote power source.
- An embodiment that can have an integral and/or remote driver.
- An embodiment that can be incorporated with embodiments retaining IOT devices.
- An embodiment that can be detachable with retaining receptacles that can be coupled to any surface.
- An embodiment that consumes minimal power.
- An embodiment that employs precision lamp optics.
- An embodiment having a reduced form factor.
- A network of power consuming egress lighting embodiments powered by at least one remote source.

Mechanical, optical and electrical innovative concepts incorporated into the design of the HLS 1 reduced form embodiment make the use of a remote centralized power source economically attractive. The innovation's controlled optics variability lend the HLS 1 embodiment's use to non-egress lighting applications.

The foregoing and other features and advantages of the present invention will be apparent from the following more detailed description of the particular embodiments of the invention, as illustrated in the accompanying drawings.

| ELEMENT LIST | |
|---|---|
| 1 | Heatsink light source embodiment |
| 2 | Heatsink |
| 3 | Fin |
| 4 | Cavity |
| 5 | Flat surface |
| 6 | Arm |
| 7 | Hinge |
| 8 | J-Box |
| 9 | Enclosure |
| 10 | Access door |
| 11 | Bore |
| 12 | Screw |
| 13 | Mechanical connector |
| 14 | Mechanical fastener |
| 15 | Retaining/mounting structure |
| 16 | Strobe light |
| 17 | Processor |
| 18 | Occupancy sensor |
| 19 | Inverter |
| 20 | Electrical receptacle |
| 21 | Light source |
| 22 | Lamp |
| 23 | Battery |
| 24 | Conduit |
| 25 | Driver |
| 26 | Electronic device |
| 27 | Camera |
| 28 | Exit sign |
| 29 | Indicator |
| 30 | Transceiver |
| 31 | Mic/Speaker |
| 32 | Air quality/Smoke sensor |
| 33 | Communication device |
| 34 | Exit Light module |
| 35 | Exit sign luminaire |
| 36 | Chevron |
| 37 | Conductor |
| 38 | Electrical receptacle |
| 39 | IOT device |
| 40 | Micro and/or nano optics |
| 41 | Micro optics |
| 42 | Nano optics |
| 43 | Field of illumination |
| 44 | Sub-field of illumination |
| 45 | Lens |
| 46 | Tf (Target field) |
| 47 | "S" (Short) |
| 48 | "M" (Medium) |
| 49 | "L" (Long) |

-continued

| ELEMENT LIST | |
|---|---|
| 50 | Path of egress |
| 51 | Optical control device |
| 52 | Stand alone egress light luminaire |
| 53 | Egress light/exit sign luminaire combo |
| 54 | Egress light/ambient light luminaire |
| 55 | Ambient light luminaire |
| 56 | Electrical device housing |

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1C:
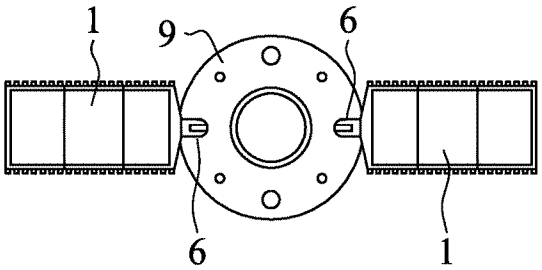
FIGS. 1A-1F shows bottom views of several exemplary configurations of HLS embodiments coupled to the same size retaining structure enclosure.

The present innovation relates to an illumination solution that forms a continuous and uniform illuminated path. The path width, illumination light levels and uniformity ratios can be maintained regardless of the building's ceiling height.

Referring to the drawings, the present innovation addresses the code requirements for illuminated path of egress by developing a novel heatsink light source (HLS) 1 embodiment. The novel embodiment is configured to illuminate a long path uniformly, consuming low energy and eliminating the need for aiming the HLS 1 embodiment regardless of the embodiment's mounting height. This novel design employs mechanical, optical and electronic concepts that differ from today's art.

The mandated code path of egress 50 requires that in the event of a power outage, building occupants should be able to follow an illuminated path to the building exit doors. In addition to the illuminated path, illuminated exit sign 35 chevrons 36 shall point in the direction of the exit door/s. The code also mandates the width of the path and the number of exit doors based on the building's occupancy load designation. The selected light source embodiment is required to illuminate the path for a duration of time (typically 90 minutes) while maintaining the light levels no less than a prescribed minimum with a light level uniformity ratio threshold.

Manufacturers of egress lighting embodiments commonly employ off the shelf lamp source modules, reflectors and lenses. While meeting the code requirement, employing off the shelf devices does not deliver optimal energy and optical results, also leaving an installing contractor with aiming the light source to form a legal path of egress. The conventional art light emitting embodiment can require as many as three light source embodiments to generate a uniform linear path of egress. To generate the same linear path, the present innovation employs fewer light sources embodiments, consuming significantly less power.

Establishing a long, linear path of egress below a light source embodiment demands emitting the light uniformly and efficiently. The light beam spread in a natural form widens as it travels away from the light source. To mitigate this phenomenon, an optical device corrects the beam's pattern. Since the light source embodiment's distance to the pathway's surface below is shorter than the distance to the other end of the pathway, a corrective optics is required to mitigate the beam intensity along the length of the path of egress 50. Such a feature and an efficient way to maintain the egress path width along its full length is absent in today's art.

The present innovation employs lens optics that control the light exit angles, both horizontally and vertically. In so doing, the light levels maintain uniformity along the length of the path of egress, prevent spillover to the sides beyond the pre-determined path width, reduce energy consumption, and extend the length of the path beyond present art capability.

This feat is accomplished by establishing at least two sub-fields of illumination 44 along the path of egress 50—short and long distance linear fields. These fields are configured to join having seamless illuminance light levels. In the present embodiment shown in FIGS. 5*a* and 5*b*, there are three fields—short 47, medium 48 and long 49 ("S", "M", and "L").

A photonic beam is most efficient when it is unobstructed. Optical lens devices reduce the efficiency of the beam. The efficiency of a photonic beam traveling through an optical device at an acute angle is significantly reduced. Therefore, to attain optimal efficiency the light source 21 aiming angle should be approximately perpendicular to a lens 45 aiming for a location within a designated field of the egress pathway 50. The light source 21 employed in this embodiment is planar, coupled to a flat mounting surface 5 formed in the heatsink 2 to facilitate the optimal positioning of the planar light source 21.

In this embodiment, the three fields of illumination (fields "S", "M", and "L") dictate the curved form of the embodiment's light source 21 housing. The heatsink 2 is monolithically fabricated with heat dissipating fins 3. The fins 3 are located at least at one opposite side of a surface onto which a planar light source 21 is coupled. The planar light source 21 retaining surface/s can be exposed across the light source 21 retaining side of the heatsink 2 embodiment or can be recessed inside a formed cavity.

The embodiment's 1 light source lamp 22 orientation is configured in relationship to the path of egress 50 below. The light source 21 is configured to provide output to reach a designated sub-field 44. The optical control device/s 51 are required to shape each sub-field 44 beam pattern and illuminate the fields uniformly as if they were a single field. Each sub-field's 44 optical control device 51 pattern design is configured to: A. Consume minimal energy B. Maintain same or similar width of path C. Maintain same or similar light levels as measured on the center of the path of egress with a meter facing up D. Maintain a min/max uniformity ratio that conforms with code, preferably no greater than 1:5 E. Extend the length of the pathway as far as possible, originating from a point below the HLS 1 embodiment.

To accomplish these tasks, this innovation relies on reduced form common but not exclusive to micro and/or nano optics 40. Reduced form optics lens corresponds to the size of lamp 22 it placed over. For low output embodiment as called for in this innovation, the planar lamp 22 size is equal or less than 5 mm. Each of the surfaces retaining the light sources 21 can have at least one lamp 22. The micro/nano optics 40 is typically positioned over the lamp 22. The micro/nano optics lens 45 is often but not always fabricated with at least one light source 21 dedicated optics. Since the targeted center of the field of illumination is at a different distance, the typically dedicated micro/nano lamp optics 41, 42 are configured to meet the field's required illumination pattern. It may also be assumed that within any field, the micro/nano optics 41, 42 can be configured to optimize the optical performance by having the optics' center beam aim at the specific areas within the designated sub-field 44.

Employing a plurality of micro and/or nano optics 40 over a planar light source 21 is highly efficient for light emittance. The optical control device 51 can be fabricated from transmissive materials such as polymer, borosilicate, and any other material having equal or better performance properties needed, and a combination thereof. The lens material also delivered in planar form is configured to align over the light source 21 center beam. A single lens 45 can be pre-configured to align with a plurality of light sources 21 that are coupled to the HLS 1 embodiment's flat surface 5. A single optical control device 51 can be configured to accommodate different number, sizes and shapes of light sources 21. The lens 45 can cover at least one flat surface 5 of the HLS 1 embodiment.

Until recently the fabrication of micro and/or nano lenses 40 was not widely available for mass commercial use, due to the prohibitive cost of manufacturing. Emergent technology makes the use of such optics economically feasible for use with illumination devices. Fabrication methods today include the older electron beam lithography (EBL) that is becoming more efficient. More recently, the direct serial machining technology with a discharged particle beam is becoming popular through 3D printing. Lamps of small form factor are typically more efficient that their larger counterparts. These lamps' output directed through micro and/or nano optics attain maximum optical efficiency, resulting in reducing the HLS 1 power consumption, and directly contributing to the HLS 1 embodiment's reduced size.

The optical arrangement of the HLS 1 embodiment can be configured for a number of spacing/mounting height ratios. The present embodiment is configured for a ratio of 1:1.5. This ratio translates into a mounting height for the HLS 1 embodiment of 20 feet directly above the path of egress 50 and a 30 feet long path of egress 50 that conforms to the code requirements. When two opposing HLS 1 embodiments are positioned back to back, aligned at the same mounting height, the path of egress below will be no less than 60 feet long. That said, the higher the light source mounting, the longer is the path of egress 50.

To control the light emission spread at various heights, different lenses 45 are used. Table 1 shows lens 45 types to be used at mounting heights from 8 to 40 feet above the path of egress 50. Type A optics used for mounting heights up to 16 feet above finished floor can also use a different optical lens 45 that can generate a mounting height to length of path ratio of 1:5. The optical lens configuration change required for various mounting heights; also accounts for pre-configured suitable lamp source output, lamp quantity and size. Tables 1 and 2 below can be an online designer tool to specify the height compatible HLS 1 embodiment. A link (not shown) can generate the embodiment's predictive photometric layout.

TABLE 1

Light Source Embodiment - Optical Configuration & Input Power

| Assembly Configuration | | A B C D | | | | | | | |
|---|---|---|---|---|---|---|---|---|---|
| Mounting Height (AFF) | Optical Config. | Watt Input Ea. | Lamp/s Output (L) | Color Temp | Assembly Config. Watt | | | | Driver Type** |
| 8-16 Ft* | A | _W | _L | _° K | _W | _W | _W | _W | A |
| 16-24 Ft | B | _W | _L | _° K | _W | _W | _W | _W | A |
| 24-32 Ft | C | _W | _L | _° K | _W | _W | _W | _W | B |
| 32-40 Ft | D | _W | _L | _° K | _W | _W | _W | _W | B |

*The optical configuration for Type A can be offered with an elongated path of egress

The driver can be configured for multi-channel and variable output at factory or on site Having the same HLS 1 heatsink embodiment that by changing lens 45 optics and light sources/s 21 can accommodate variability in mounting height is novel. Table 2 is an example for a lighting professional to configure suitable optics and system power input for various HLS 1 embodiment configurations at a range of mounting heights. The HLS 1 embodiment can be mounted as a stand-alone emergency egress luminaire 52, coupled to an exit sign 53, coupled to an ambient lighting luminaire 54 or to an enclosure 9 such as a common J box 8. Both the enclosure 9 and the HLS 1 embodiment sizes can vary to suit the illumination requirements. An enclosure 9 such as the J box 8** can be mounted to a ceiling, suspended from the ceiling with a conduit of pendant, mounted onto a wall, or recessed in a wall.

TABLE 2

| Optical Configuration Type B SC = 1:2 Mounting Height:Illuminated Field Length | | | | | | | | |
|---|---|---|---|---|---|---|---|---|
| Single Light Source Embodiment | | | | | Back to Back Two Light Source Embodiment | | | |
| Mounting Height (Ft) | Field Length (Ft) | FC Max | FC Min | Uniformity Ratio | Field Length (Ft) | FC Max | FC min | Uniformity Ratio |
| 16 | | | | | | | | |
| 17 | | | | | | | | |
| 18 | | | | | | | | |
| 19 | | | | | | | | |
| 20 | | | | | | | | |
| 21 | | | | | | | | |
| 22 | | | | | | | | |
| 23 | | | | | | | | |
| 24 | | | | | | | | |

Electrical devices such as at least one driver 25 can be placed inside the J box 8 or an alternate enclosure 9. A driver 25 can have multi-output tracks providing power to the light source 21 or the light source and other TOT devices 39. Employing an enclosure 9 with HLS 1 embodiments and a dedicated driver 25 has a significantly smaller form factor than present art. The efficient utilization of a light source 21 results in lesser heat generated, that in turn requires a smaller heatsink 2. In an alternate embodiment, an HLS 1 embodiment can have a dedicated lamp driver 25. The driver can be coupled to the light source's 21 substrate, directly to the flat surface 5 of the HLS 1 embodiment, or to the HLS 1 arm 6 (not shown). Having no emergency back-up power supply such as a battery 23 coupled to a ceiling mounted egress lighting luminaire, significantly reduces operational cost.

The batteries 23 at end of life need replacement. Not all batteries 23 age at the same rate. For maintenance staff, keeping all ceiling mounted battery 23 back-up HLS 1 embodiments in good operating condition requires vigilance. Further, having small form HLS 1 embodiment/s coupled to lamps with a driver 25 or coupled to an enclosure 9 with a driver 25 inside receiving remote power reduces the number of elements that can fail with a traditional ceiling mounted egress lighting luminaire. Today, both the lamps' and the driver' life expectancy rating exceed 50,000 hours, effectively requiring next to no servicing over the building's lifetime.

Up to this decade, the cost of inverters 19 has been exceedingly high. Technological developments have given new life for the inverter 19 as a prime back-up power source. These developments include the wide use of back-up power for computers, smaller batteries 23 becoming ever more efficient, having longer life, more efficient power management control, networking and integration with TOT devices. Another important contributor is the lesser load due to more efficient light sources 21. Current LED lamp 22 technology consumes a fraction of what incandescent lamp technology required for the same light level illumination. Lastly, lamp optics today can predictively deliver the right amount of light where needed while curtailing light spillover. The sum of the above attributes bodes well for the use of inverter/s 19 where ceiling mounted egress lighting can also be coupled with present day TOT devices 39.

By employing a remote power source the present innovation can also eliminate some or all egress lighting batteries in a building. The egress lighting luminaire network in a building includes existing signage which is required to be on continuously and egress lighting pathway luminaires that turn on only during house power interruption. The latter luminaire's driver can be coupled to microprocessor and a microswitch that are communicatively coupled to at least one of a communication device and/or a power interruption sensing device. When power interruption is communicated and/or sensed, the microswitch switch to the on position. The entire building emergency lighting, in one example, can operate as follows:

A. The entire network of luminaires is powered by house power with a transfer switch also coupled to the backup power source, and microswitches coupled to at least one of the emergency pathway luminaires. Exiting sign/s remain on typically receiving line power, stepping it down to low voltage.

B. In the event of power interruption, the power is switched to the backup power source. The exit sign luminaire/s remain on and the microswitch at each egress lighting pathway luminaire is switch on.

C. The entire egress lighting network of luminaires remains on until the backup power supply senses that house power has been restored. At which time, it can either communicate or send a power signature or any other signal to the egress path luminaires' microswitch, to turn on.

The HLS 1 embodiment can be used indoors and outdoors, illuminating as many as four paths of egress 50 from above, three building paths over the building egress exit doors, and a single path extending out from the building exterior exit door. The HLS 1 embodiment employs a short arm 6 that couples to a reciprocating receptacle 13, 20 in an enclosure 9 cover 10, exit sign luminaire 35, ambient lighting luminaire 55, or wall/ceiling mounted receptacle 13, 20.

The arm 6 is configured to rotate about at least two axes providing at least horizontal rotation about a vertical axis when the HLS 1 arm 6 is coupled to a receptacle 13, 20 above. It also enables horizontal rotation when the HLS 1 embodiment's arm 6 is coupled to a receptacle 13, 20 such as a J box 8 mounted to a wall or an exit sign 35 hung from a conduit 24. The arm 6 can also be adapted to retain the HLS 1 embodiment's driver 25. The driver can be placed inside or coupled to the arm's exterior. Having an HLS 1 embodiment that includes a driver enables coupling the HLS 1 to any receptacle that provides compatible power. The versatility of employing a single HLS 1 embodiment in various configurations, on different device types, in different orientations, indoors and outdoors, at various mounting heights is novel.

FIGS. 1*a*, 1*b*, 1*c*, 1*d*, 1*e* and 1*f* show a single and several HLS 1 embodiments with an arm 6 coupled to an enclosure 9. Power from the enclosure 9 can be conveyed to the heatsink 2 light source 21 embodiment through the arm 6 or at the arm's 6 exterior. The enclosure 9 can have an access door 10. At least one electronic device 26 can be coupled to the access door 10 and/or any other exterior surface of the enclosure 9 aside from the heatsink 2 light source 21 embodiment. The present embodiment shows a bottom facing access door 10 with a camera 27 positioned at its center, four each HLS 1 embodiment receptacles 13, 20 and four bores 11 for securing the access door 10 to the enclosure's 9 body.

Figure 1B:
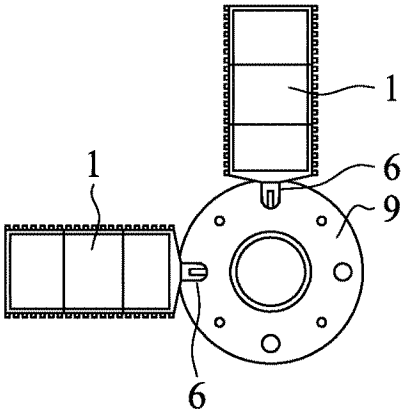
Figure 1A:
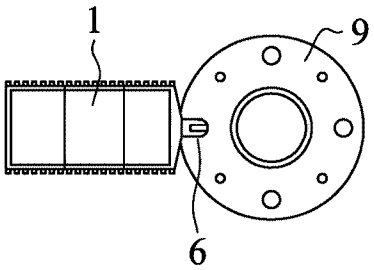

FIG. 1*a* shows a single HLS 1 embodiment coupled to the enclosure 9.

FIG. 1*b* shows two HLS 1 embodiments coupled to the enclosure 9 at 90° in relation to the enclosure's 9 vertical center axis.

FIG. 1*c* shows two HLS 1 embodiments coupled to the enclosure 9 at 180° in relation to the enclosure's 9 vertical center axis.

Figure 1F:
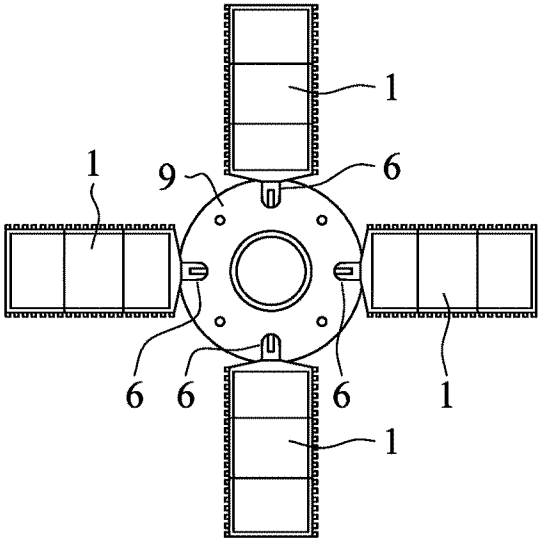
Figure 1E:
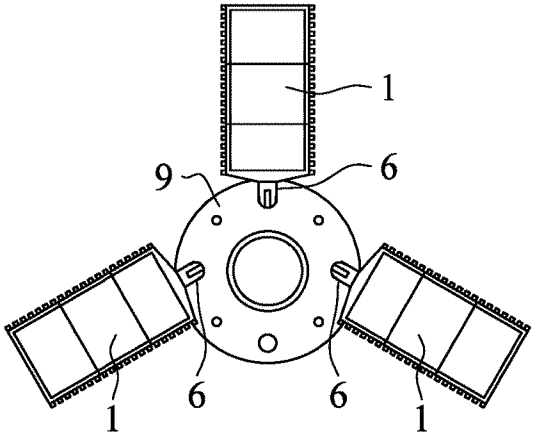
Figure 1D:
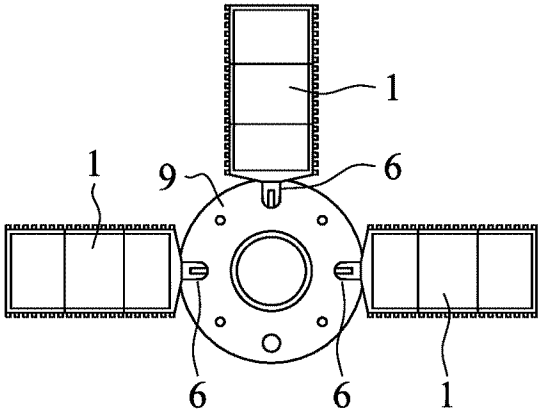

FIG. 1*d* shows three HLS 1 embodiments configured as the letter "T" with embodiments at 90° to the middle embodiment in relation to the enclosure's 9 vertical center axis.

FIG. 1*e* shows three HLS 1 embodiments configured at 120° to one another in relation to the enclosure's 9 vertical center axis.

FIG. 1*f* shows four HLS 1 embodiments configured at 90° to one another in relation to the enclosure's 9 vertical center axis.

The HLS 1 embodiment's arm 6 can be configured to enable vertical, horizontal, and/or horizontal and vertical embodiment rotation in relation to the exterior face/s of the enclosure 9 embodiment.

Figure 2B:
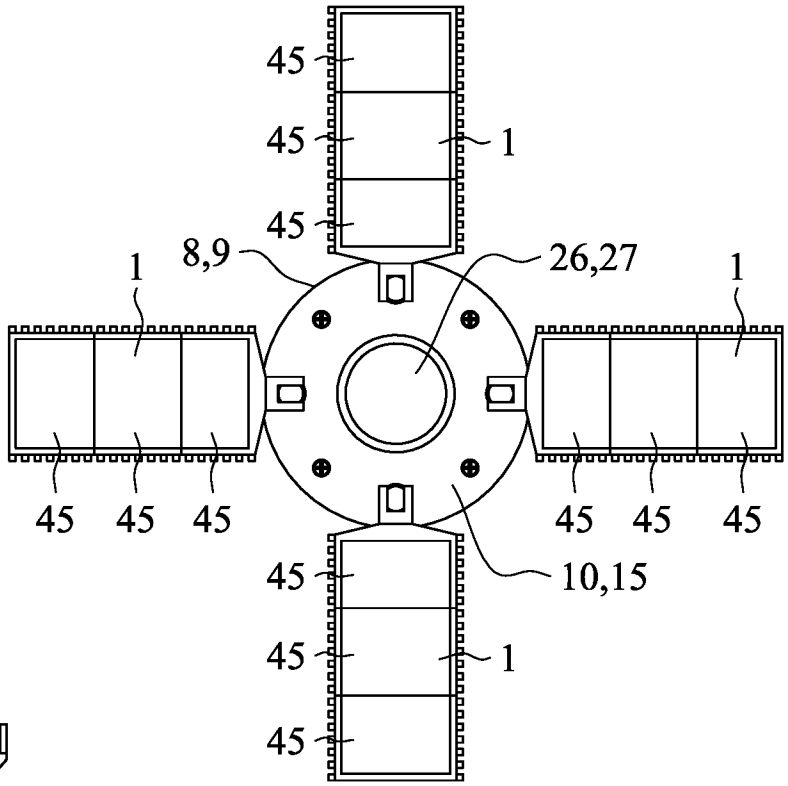
FIGS. 2A-2B shows side and bottom views of a horizontally mounted enclosure coupled to a plurality of HLS embodiments.
Figure 2A:
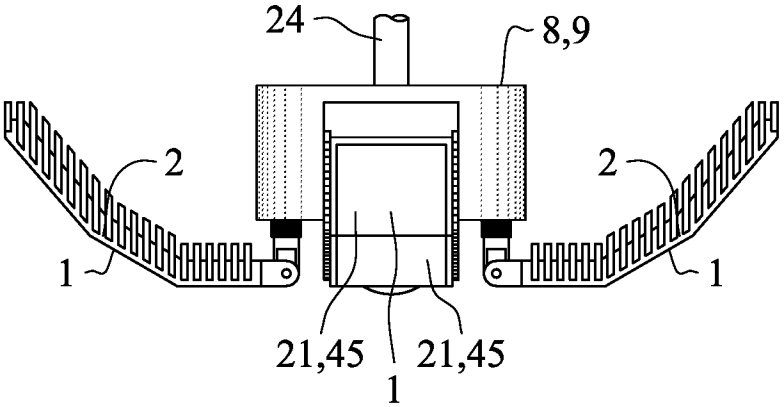

FIGS. 2*a* and 2*b* show an assembly of HLS 1 embodiments coupled to an enclosure 9 in elevation and bottom side plan view. This assembly is configured to be mounted horizontally by a conduit 24 from above, or against a mounting structure 15. This embodiment arm 6 is hidden behind the heatsink 2 as well as another embodiment at 180° on the enclosure's 9 opposite side. The enclosure 9 body can be a standard J-box 8 of various standard industry dimensional heights, widths and forms. It can include "knock outs" and/or screw-out bores 11 in the side, top and bottom exterior faces. The enclosure 9 can be expandable or having at least two volumetric areas that can be mechanically coupled.

FIG. 2*a* shows an elevation with two HLS 1 embodiments at 180° to one another coupled to an enclosure 9 by arms 6 and an additional HLS 1 embodiment between with the embodiment's light source 21 lamp lens 45 shown facing forward.

FIG. 2*b* shows a bottom plan view of a four HLS 1 embodiment assembly coupled to an enclosure 9 with an electronic device 26 other than the light sources 21 coupled to the enclosure's 9 door center. In this example the device shown is a camera 27. Other enclosure devices can include a single or plurality of devices including at least one of: smoke/air quality sensor 32, occupancy sensor 18, transceiver 30, strobe light 16, speaker/microphone 31, indicator light 29, and a processor with or without resident memory 17 and/or other output/sensing devices. The camera 27 device shown can be supported by rudimentary and/or AI code providing real-time information about environments' sensed conditions in the vicinity of the camera device.

Figure 3B:
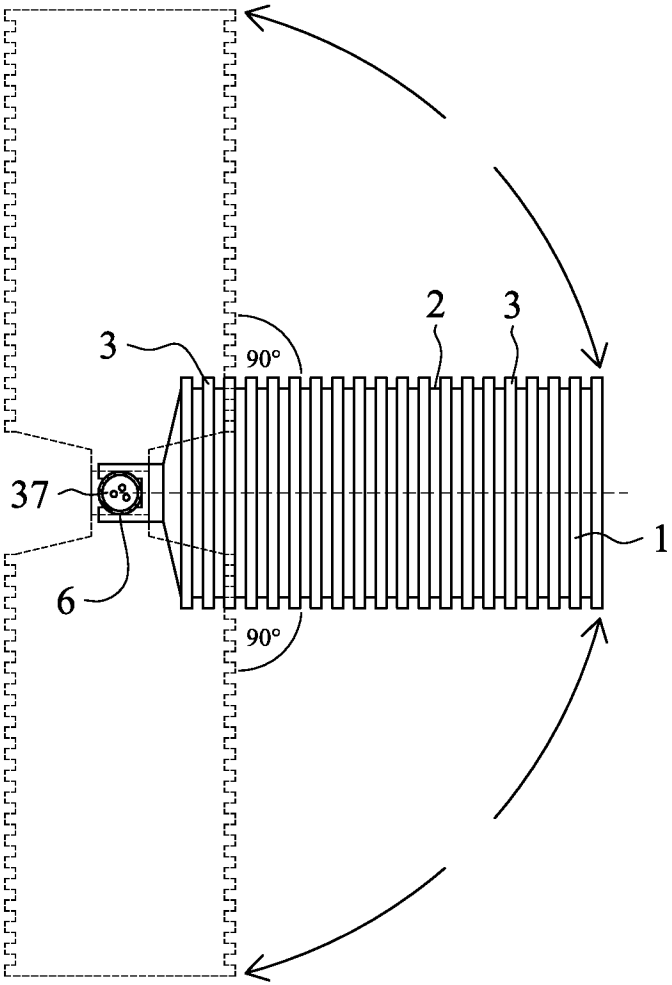
FIGS. 3A-3B shows in side and top views the HLS embodiment's rotational capability when mounted to horizontal and vertical surfaces.
Figure 3A:
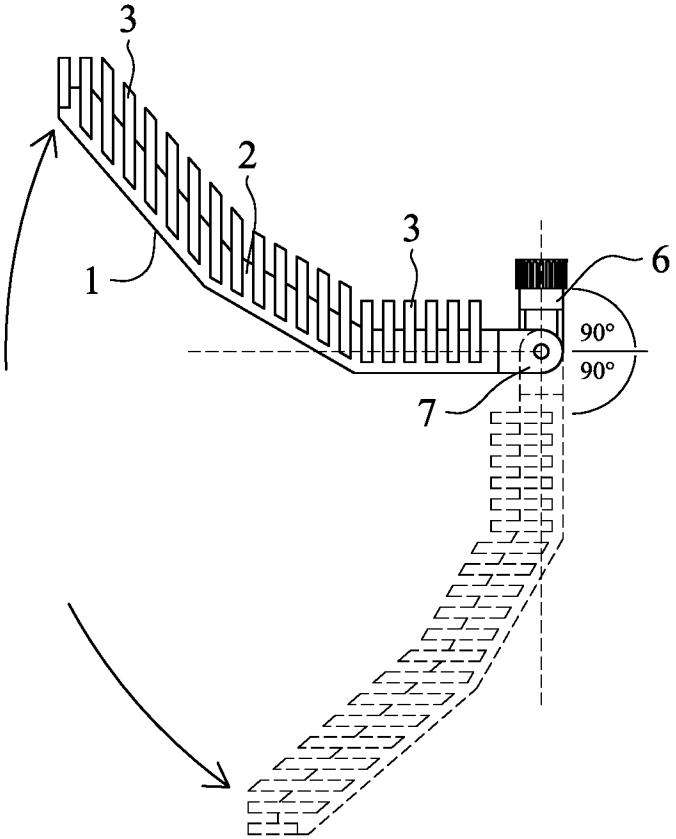

FIGS. 3*a* and 3*b* show the HLS 1 embodiment arm's 6 vertical and horizontal orientation capabilities.

FIG. 3*a* shows the arm 6 coupled to the HLS 1 embodiment disposed in a vertical position. The HLS 1 embodiment arm's 6 coupled position is horizontal at approximately 90° to the arm's 6 vertical axis. A mechanical connector 13 couples the arm 6 to a retaining structure 15 above (not shown). Electrical conductors 37 inside the arm 6 can convey electricity from the mechanical connector 14 coupling end of the arm 6 to the light source/s 21 coupled to the heatsink 2. In another embodiment (not shown), the conductors 37 can be external to the arm 6. A hinged 7 connector coupled to the HLS 1 embodiment enables rotation of the heatsink 2 embodiment from the horizontal position shown to a vertical position, to form an approximately 180° alignment between the arm's 6 central vertical axis and at least a portion of the heatsink's 2 embodiment. The figure indicates the alignment showing the embodiment in dash lines and the rotational mobility with arrows.

The alignment feature adds versatility to the HLS 1 embodiment wherein one embodiment can be suitable for use with several types of light emitting embodiments, where varied orientation is needed. FIGS. 3, 8 and 10 show the HLSs' 1 arm's 6 vertical rotational capability.

FIG. 3*b* shows the arm 6 coupled to the HLS 1 embodiment from above wherein the heatsink's 2 arm 6 is shown in section. The arm 6 vertically disposed is at 90° to at least a portion of a horizontally coupled HLS 1 embodiment. Inside the arm 6, electrical conductors 37 convey power from a remote location into the heatsink's 2 light source 21. In this embodiment, the HLS 1 embodiment can horizontally rotate no less than 1° to the right or the left. The embodiment rotates about the arm 6 wherein the arm 6 in one embodiment can be fixed at or below the coupling point to the retaining structure 15 or can permit rotational mobility. This figure shows in dash lines embodiments disposed on the right and the left sides of the embodiment shown in solid line, and arrows showing an example at 90° rotational mobility for each. FIGS. 3, 8 and 10 show the HLS's 1 arm's 6 horizontal rotational capability.

FIGS. 4*a*, 4*b*, 4*c* and 4*d* show elevations of the HLS 1 coupled to horizontal and vertical oriented enclosures 9.

Figure 4C:
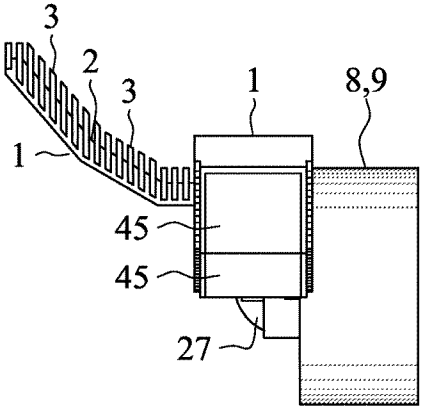
FIGS. 4A-4D shows in side, bottom and frontal views the HLS embodiments coupled to horizontally and vertically mounted enclosures.
Figure 4D:
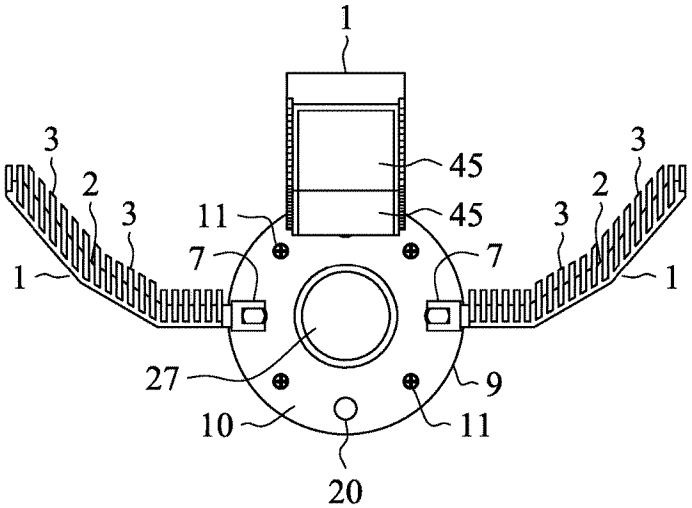
Figure 4A:
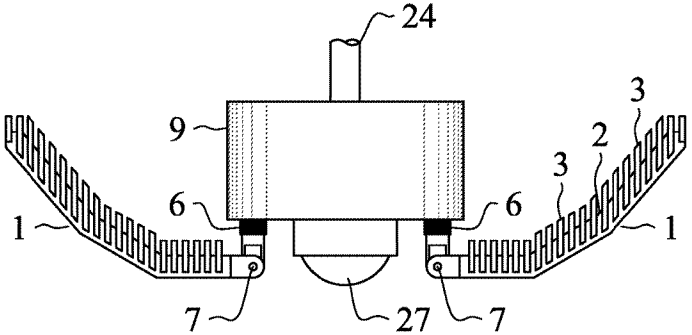

FIG. 4*a* shows an elevation view of a horizontally oriented enclosure 9 coupled to a conduit 24 on its top face and to two HLS 1 embodiments at its bottom face. The embodiments shown are at 180° to one another with a camera 27 device mounted to the enclosure's 9 bottom face at the center between these two HLS 1 embodiments.

Figure 4B:
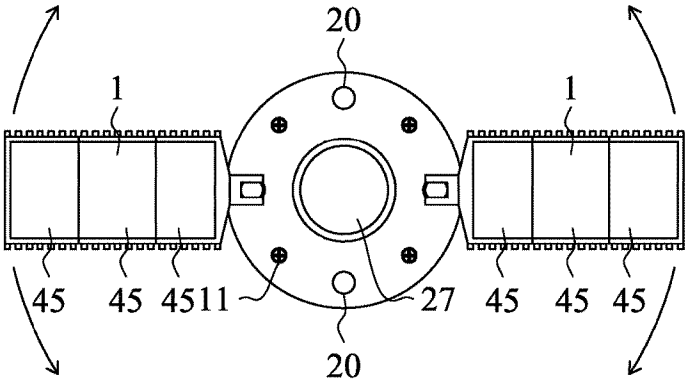

FIG. 4*b* shows the above assembly bottom view with the two HLS 1 embodiments at 180° to one another and a camera 27 coupled to the enclosure's 9 access door 10 at the center between the two embodiments. Also shown on the access door 10 are two vacant electrical receptacles 20 perpendicularly disposed to the HLS 1 embodiments.

Arrows designate the embodiments' horizontal rotational ability about their respective mounting arms 6.

FIG. 4*c* shows an elevation view of a vertically oriented enclosure 9 coupled to a wall showing HLS 1 embodiments and a camera 27 device mounted to a vertical face of the enclosure 9 that is also an access door 10. The enclosure 9 can be surface mounted, or recessed partially or wholly in a wall, floor or ceiling.

FIG. 4*d* shows a frontal view of an enclosure's 9 access door 10 onto which three HLS 1 embodiments are coupled. Two of the heatsink 2 embodiments are oriented at 180° to one another in relation to the door's 10 radial center, with a third heatsink 2 mounted above between them. At the center of the access door 10 a camera 27 shown provides 180° visibility in front of the assembly. Arrows designate the embodiments' vertical rotational ability about their respective mounting arms 6.

Figure 5B:
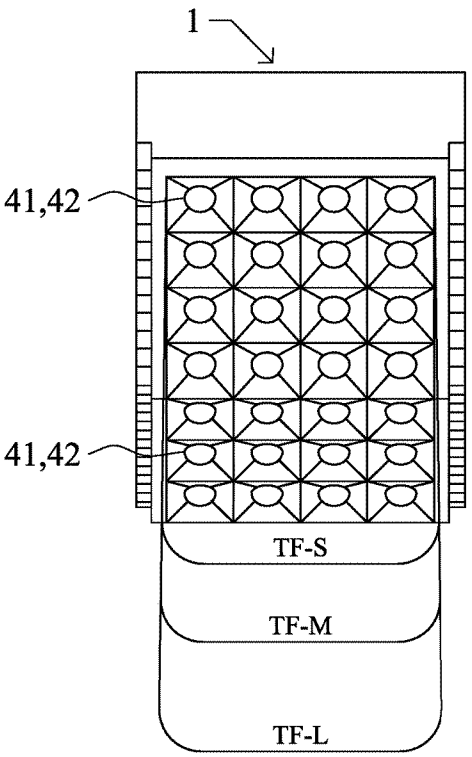
FIGS. 5A-5B shows side and frontal views of the HLS embodiment with depiction as to the light emittance corresponding to each of the HLS embodiment's flat surfaces.
Figure 5A:
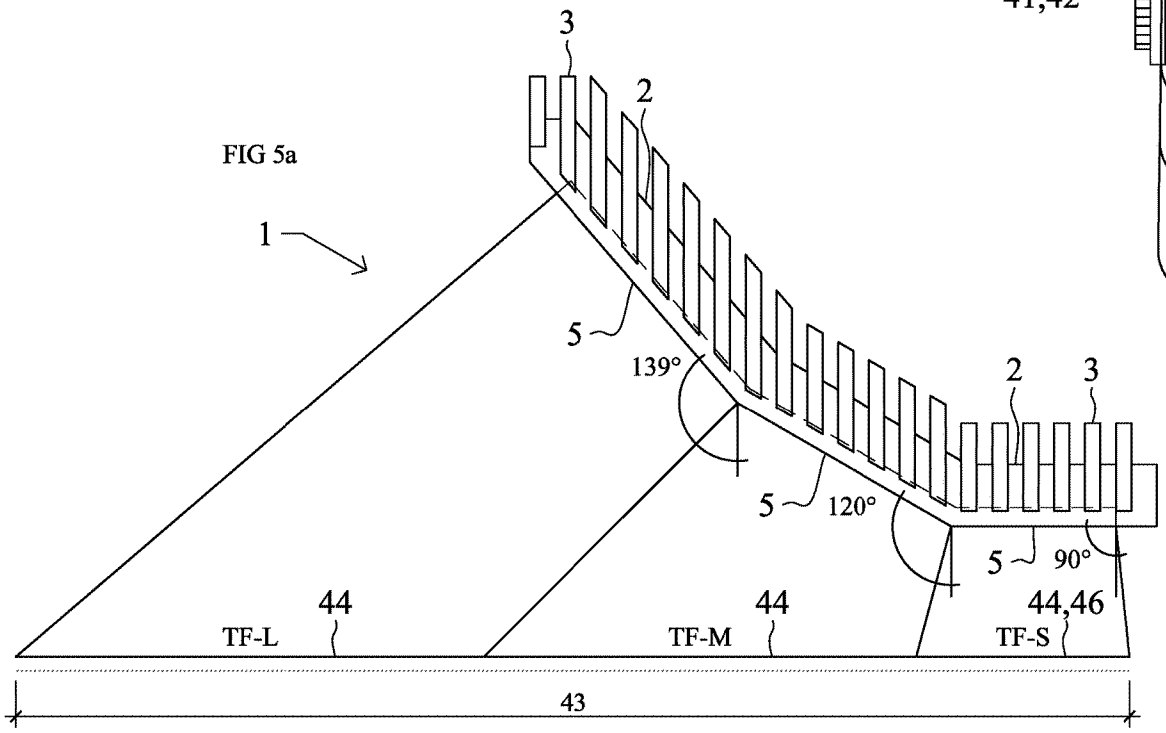

FIGS. 5*a* and 5*b* show side and frontal elevations of a heatsink 2 retaining a light source 21. The heatsink 2 embodiment is monolithically fabricated with heat-dissipating fins 3 on at least the top side and at least two flat surfaces 5 on the opposite side to the fins 3. At least two lamps 22 are coupled to the flat surface 5, a lamp 22 on each surface 5. The lamps 22 are covered by at least one micro 41 and/or nano 42 lens 45 wherein the entire assembly is secured to a retaining structure 15 by an arm 6 coupled to the heatsink 2 embodiment (not shown).

FIG. 5*a* shows a side elevation of the heatsink 2. This elevation shows an example of an embodiment having three flat lamp retaining surfaces 5 (lamps not shown). This innovation pre-configures the light intensity and light beam pattern requiring no aiming in the field. Lamps 22 coupled to each heatsink flat surface 5 illuminate a section of a contiguous field comprising several sub-fields 44, forming a uniformly illuminated horizontal or vertical plane. In the present embodiment, lamps 22 that are coupled to each flat surface 5 illuminate sub-fields "S", "M" and "L" (short, medium and long). To attain illumination uniformity while meeting the light levels desired using minimal power consumption, the flat surfaces' 5 orientation is configured to retain the lamps' 22 light beam center light dispersion at an approximate right angle to their respective flat surfaces 5 they are mounted on. The center light beams are pre-configured to target a specific location within a field, while at least the majority of flat surface 5 lamps 22 uniformly illuminate their designated sub-field 44. The HLS 1 embodiment's form is derived by the flat surfaces 5 retaining the lamps 22. The number, size and power input to the lamps 22 is dependent on each surface distance from its designated field of illumination 43 and the entire HLS 1 from the nearest field to be illuminated 43. The present elevation shows a line below designated as Tf 46 (Target field). Surface A1 is shown as the nearest surface to Tf 46 with angle A1 approximately parallel to Tf 46. The relatively short proximity to field "S" as compared to fields "M" and "L" requires at least one of lesser area, number of lamp/s, and/or lamp input power to illuminate the "S" field.

Similarly, angle A2's flat surface 5 area covers the "M" field and angle A3 covers the farthest field "L" within the Tf 46 requiring more surface area to accommodate a sufficient number of lamps 22, and power input to provide the same light levels as in field "S", while maintaining illumination uniformity and light pattern form.

FIG. 5*b* shows in a frontal view the three flat surfaces 5 of the HLS 1 embodiment. Projected diagrammatically from each flat surface is an isoline covering the flat surface sub-field 44. The nearest isoline designated by the letter "S" (short) is the target field nearest to the HLS 1 embodiment. Isoline "L" is the farthest away from the HLS embodiment. This frontal elevation captures the relative size of the flat surface tasked with illuminating sub-field "L" and the flat surface illuminating sub-field "M". It is apparent from the figure that the area of the flat surface illuminating sub-field "L" is significantly larger than the area allotted for sub-field "M".

The heatsink 2 embodiment can be fabricated of metallic or non-metallic material. The embodiment can be painted and made to conform to indoor and outdoor conditions. In addition, the embodiment can be made to endure special harsh environments designated as hazardous and/or submerged.

Figure 6C:
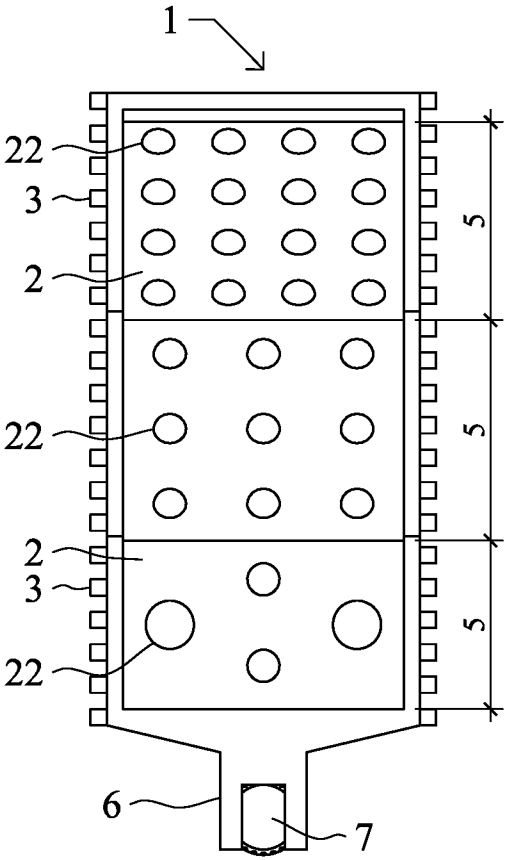
FIGS. 6A-6C shows several frontal views of the HLS embodiments with different lamp configurations for each embodiment.
Figure 6B:
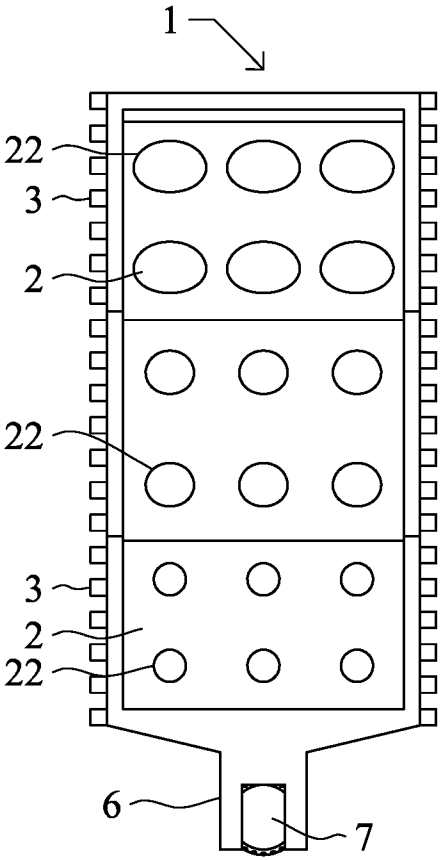
Figure 6A:
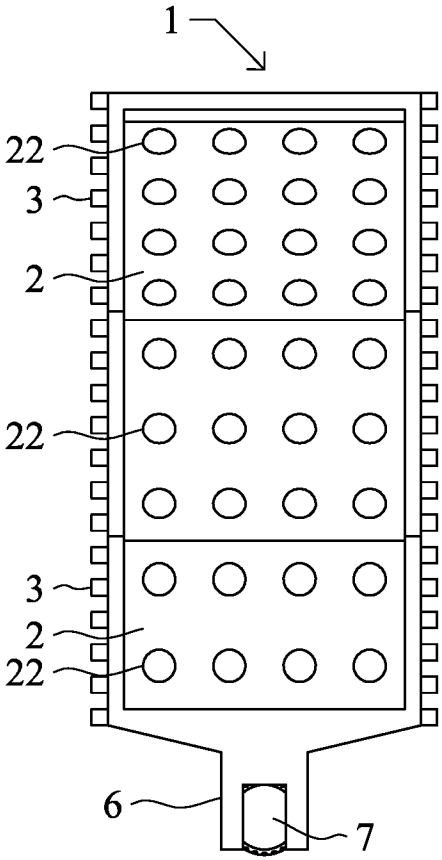

FIGS. 6*a*, 6*b* and 6*c* show a frontal elevation of the HLS 1 embodiment's flat surfaces 5 with coupled lamps 22. On the left side of the page a demarcation line shows each flat surface 5 with coupled lamps 22 corresponding to the illumination fields 43 as described in FIG. 5*a*. The "S" at the figure's bottom corresponds to the nearest illuminated field, while the "L" surface at the surface top of the figure corresponds to the farthest field from the heatsink 2 embodiment. The coupled rotational arm 6 (not shown) is typically coupled to a heatsink 2 wall in proximity of flat surface "S".

The flat surfaces 5 retaining the lamps 22 are a key element of the monolithically fabricated heatsink 2. The number of flat surfaces 5 can vary between types of heatsinks 2 contingent on the application. Regardless of the application, the flat surfaces' 5 angle in relation to the horizon line vary from one flat surface 5 to the next when each surface is tasked with illuminating different sub-fields 44. The center beams of the lamps 22 coupled to the flat surfaces 5 are pre-configured to aim in the direction of their respective sub-fields to be illuminated 22.

FIG. 6*a* shows an example of three flat surfaces 5 comprised of a different area and retaining a different number of same size lamps 22. The smallest flat area next to the letter "S" is responsible to illuminate the nearest illumination sub-field 44, thus requiring fewer lamps 22 and/or power input than the large flat area next to the letter "L", whereas the coupled lamp 22 light has to travel the farthest to illuminate its designated field. In this embodiment the number of lamps 22 corresponding to the short travel is 8*ea*, and 16*ea* for the lamps corresponding to the long travel.

FIG. 6*b* employs the same HLS 1 embodiment as in FIG. 6*a*, with the same number of flat surfaces 5 and surface orientation angle having different size lamps 22 coupled to each surface 5.

FIG. 6*c* employs the same HLS 1 embodiment as both embodiments shown in FIGS. 6*a* and 6*b*. This figure shows a combination of different size lamps 22 coupled to at least one flat surface 5.

In addition to the size and quantity of any lamp coupled to a flat surface 5, the lamps 22 coupled can also differ by at least one feature including CRI, color temperature, lamp voltage, lamp wattage and/or lamp retaining sub-strut material and/or color.

Figure 7C:
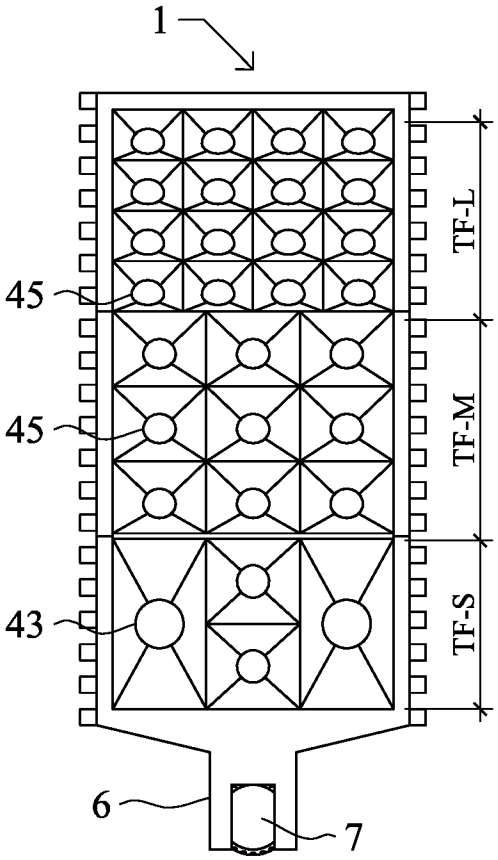
FIGS. 7A-7C shows several frontal views of the HLS embodiments with different lens optical configurations for each embodiment.
Figure 7B:
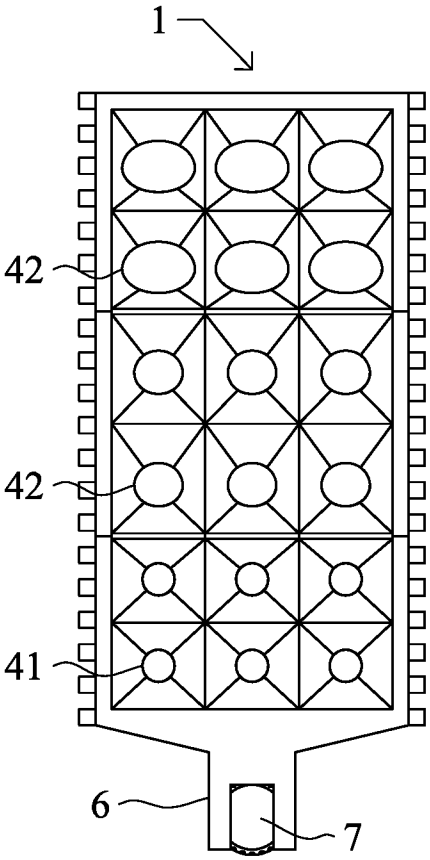
Figure 7A:
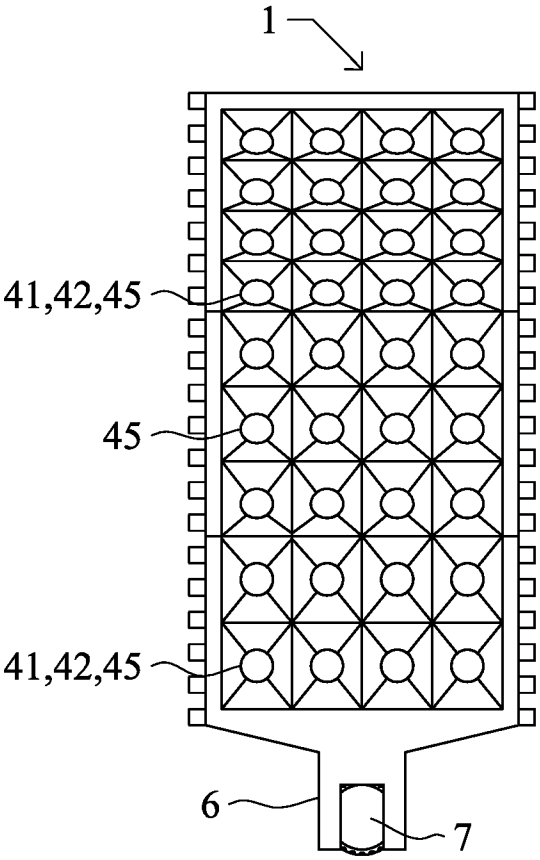

FIGS. 7*a*, 7*b* and 7*c* show a frontal elevation of the HLS 1 embodiment's flat surfaces 5 with lens/es 45 covering lamp/s 22 that are coupled to the HLS 1 embodiment's flat surfaces. The lens/es 45 employed include micro 41, nano 42 or combination of the two types. In other embodiments the lens 45 can be coupled to an individual lamp 22 (not shown). The heatsink 2 is comprised of at least two flat surfaces 5 onto which at least one lamp 22 is coupled to each surface 5. The lens 45 can be disposed over at least one of a lamp 22, a flat surface 5, a plurality of flat surfaces 5, a plurality of flat surfaces 5 and a single flat surface 5.

FIG. 7*a* shows a single lens 45 covering three flat surfaces 5 each with at least one lamp 22. The lens 45 optics can correspond to a single or a plurality of lamps 22. The lens 45 focal point can be the same for all lamps 22 varying between flat surfaces 5 or configured to have at least one lamp 22 focal point aim at a specific area within a field of illumination 43.

FIG. 7*b* shows a similar configuration to FIG. 7*a* with each flat surface 5 area employing a dedicated lens 45.

FIG. 7*c* shows a similar configuration to FIG. 7*b* with two of the flat surface 5 areas employing dedicated lens 45 nano optics 42, while the other employs a micro optics 41 lens 42.

Figure 8B:
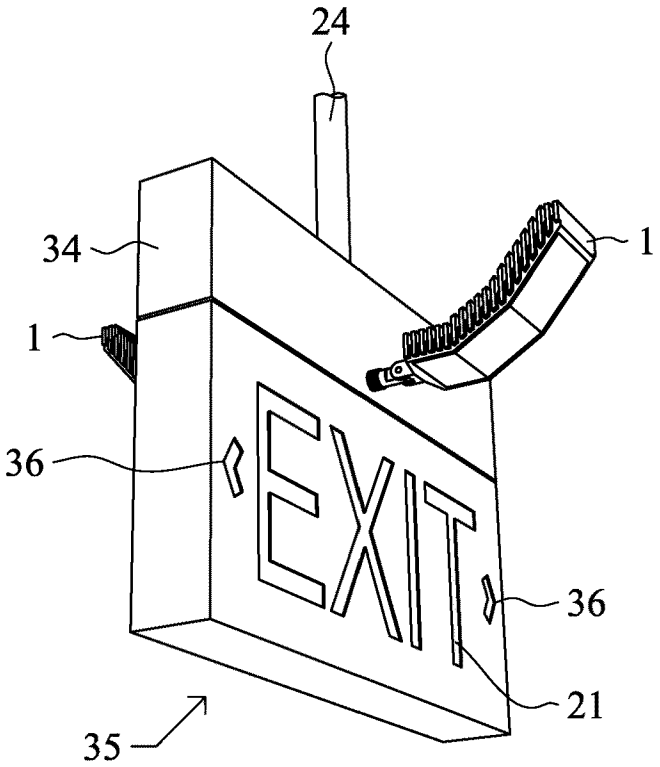
FIGS. 8A-8B shows frontal and side views of a plurality of HLS embodiments coupled to pendent/conduit/chain and wall mounted exit lighting luminaires.
Figure 8A:
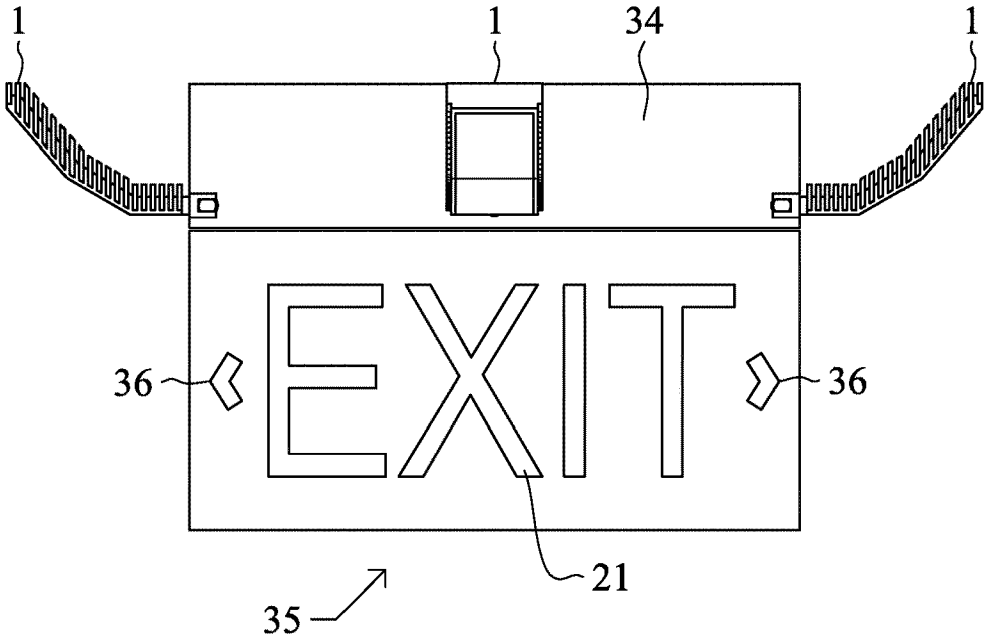

FIGS. 8*a* and 8*b* show two exit sign 35 luminaire embodiments with HLS 1 embodiments coupled to the exit luminaire 35. The exit sign letter size is mandated and so is the color of the illuminated panel and the light source 21 light output intensity through the translucent panel. The exit sign 35 is required by code to remain illuminated having backup power provision in the event of power outage. The illuminated sign can be single or double sided, hung from a pendant, chain or conduit, or wall mounted. Next to the "Exit" text, chevrons 36 disposed on both sides indicate the direction toward a "legal exit door". These chevrons 36 are also illuminated.

FIG. 8*a* shows a wall-mounted exit sign 35 luminaire. On top of the exit sign 35 three HLS 1 embodiments are shown coupled to a module 34. The module 34 can be an integral element of the exit sign 35 or a modular add-on component. The module 34 can retain at least one of a driver 25, a battery 23, an indicator light 29, a mic/speaker 31, a camera 27, a communication device 30, a processor 17, and any other output and/or sensing device. The HLS 1 embodiment can be detachable being plugged into reciprocating electrical receptacles 20 built into the module 34. The present embodiment showing three HLS 1 embodiments is configured to illuminate the field of illumination below the sign 35 on both sides and straight forward illuminating a path of egress 50 resembling the letter "T".

FIG. 8*b* shows a conduit 24 hung exit sign 35 luminaire. This embodiment employing the same or similar top module 34 is shown in side elevation having at least one light source 21 embodiment mounted to the module 34 and perpendicularly disposed in relation to the illuminated face of at least one sign 35. Also, the hung sign HLS 1 embodiments are detachable.

FIGS. 9*a*, 9*b*, 9*c*, and 9*d* show in diagram form four exemplary path of egress 50 configurations employing a ceiling mounted enclosure 9 with a plurality of HLS 1 embodiments. The HLS 1 embodiment optics is configured to emit pre-configured photonic beams illuminating a pre-configured field of illumination below. The beams maintain their horizontal spread uniformly along the path of egress 50 while maintaining light level uniformity across the longitudinal and transverse axes of the path of egress.

Figure 9A:
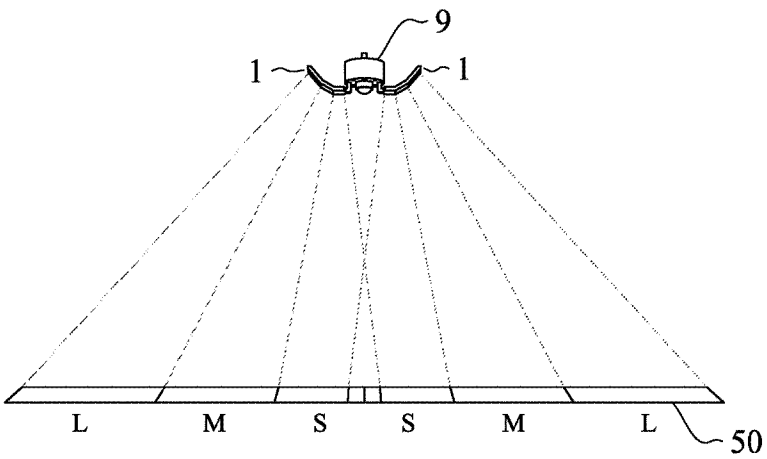
FIGS. 9A-9D shows several diagrams of field of illumination patterns generated by HLS embodiments with each diagram corresponds to a different pattern field.

FIG. 9*a* shows the linear path of egress 50 with two back to back HLS 1 embodiments coupled to a retaining enclosure 9. In this configuration the HLS 1 embodiments are aligned at 180° degrees.

Figure 9C:
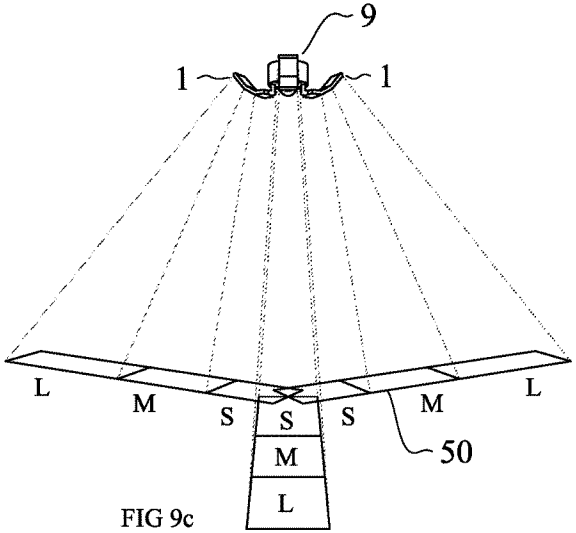
Figure 9B:
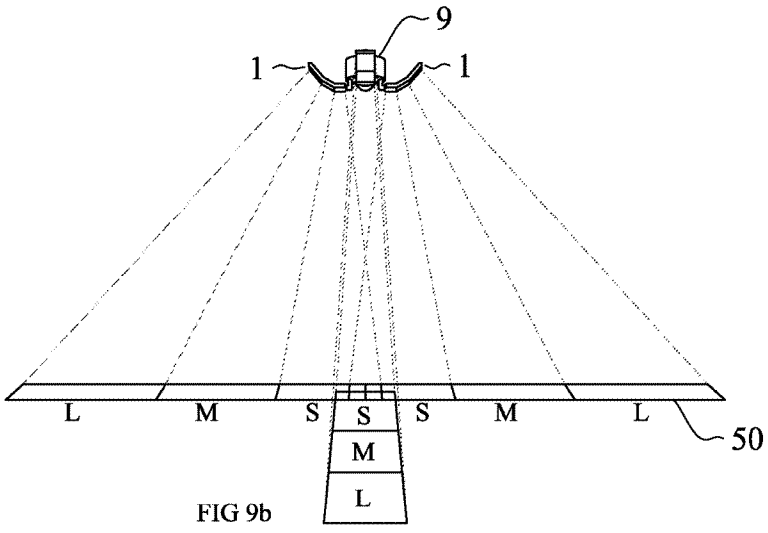

FIG. 9*b* shows the "T" configuration path of egress 50 where two HLS 1 embodiments form a linear path and a third HLS 1 embodiment is oriented to emit light at 90° degrees perpendicular to the two other embodiments.

FIG. 9*c* shows a "Y" configuration path of egress 50 where three HLS 1 embodiments coupled to an enclosure 9 form an illuminated path of egress 50 with vertices at 120° degrees to one another.

Figure 9D:
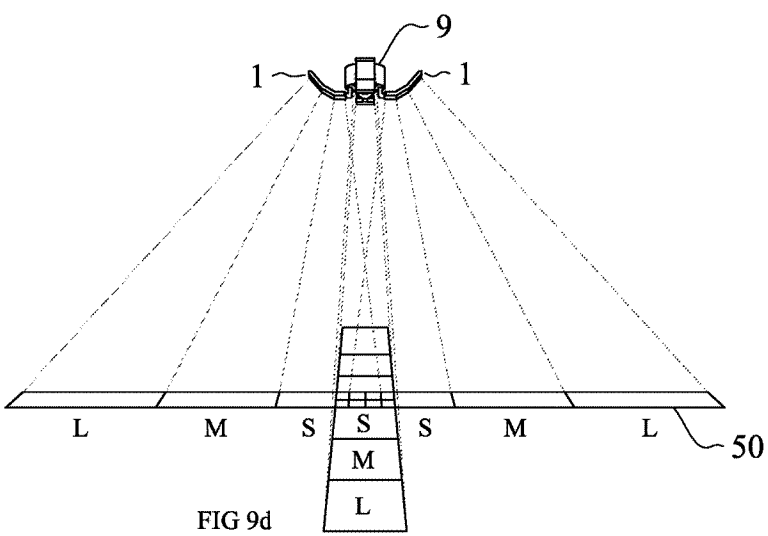

FIG. 9*d* shows a "+" (cross) configuration path of egress 50 where four HLS 1 embodiments coupled to an enclosure 9 form an illuminated path of egress 50 with four vertices at 90° degrees to one another.

Any and all of the HLS 1 embodiments are capable of rotating laterally and vertically to illuminate orthogonal and/or non-orthogonal paths of egress 50.

FIGS. 10*a*, 10*b*, 10*c*, 10*d*, 10*e*, and 10*f* demonstrate the HLS 1 embodiment's versatility. The detachable HLS 1 embodiment can be used with indoor and outdoor emergency and non-emergency luminaires. It can be mounted with an arm 6 in a vertical or horizontal position lending itself to be coupled to the floor, the wall or the ceiling. In some embodiments it can couple to a retaining structure 15 only, such as a J box 8 enclosure 9. The enclosure 9 can be surface mounted, hung or embedded inside a surface.

Figure 10A:
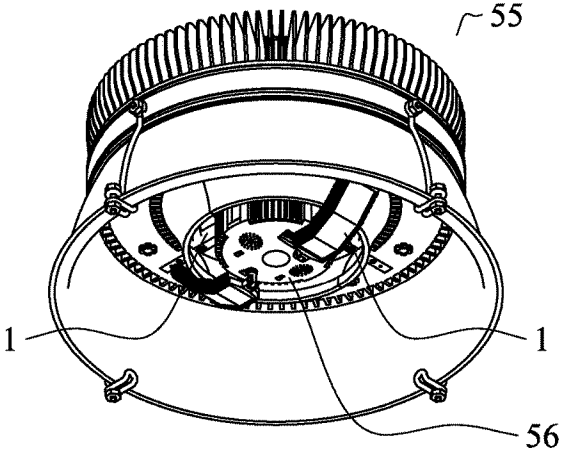
FIGS. 10A-10F shows in perspective views several HLS embodiments coupled to different functionality structures/enclosures demonstrating the utility of one embodiment for all building egress path illumination needs.

FIG. 10*a* shows an ambient lighting luminaire 55 with two HLS 1 embodiments coupled to the luminaire's electrical device housing 56 located at the luminaire's center. The detachable HLS 1 embodiments can be rotated horizontally to align with the path of egress 50 below, regardless of the ambient lighting luminaire 55 orientation. The inclusion of the HLS 1 embodiment with an ambient lighting luminaire 55 can be configured with suspended, surface-mounted or recessed in the ceiling ambient lighting luminaires 55.

Figure 10B:
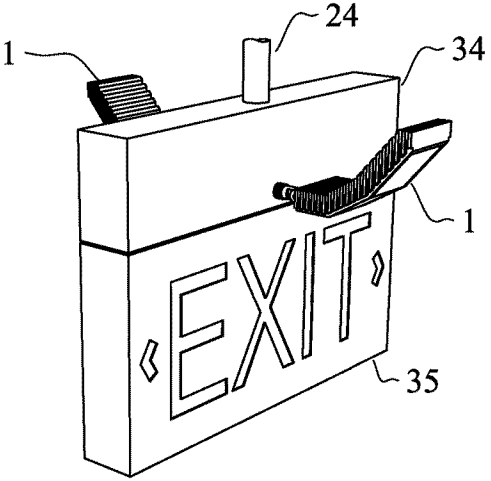

FIG. 10*b* shows a conduit 24 hung exit lighting sign 35 with two HLS 1 embodiments coupled to a top module 34 on the opposing sides. In additional to the exit sign 35 utility, the HLS 1 embodiment can illuminate an egress path 50 below, eliminating a need for egress path luminaire placement in proximity to the illuminated exit sign 35.

Figure 10C:
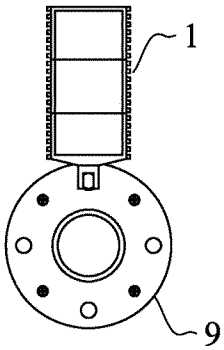

FIG. 10*c* shows an HLS 1 embodiment coupled to an enclosure 9. The enclosure 9 can be a standard J box 8, it can be surface-mounted, or it can be recessed in a surface. In this example, the HLS 1 embodiment can be placed outdoors over a legal exit door. This embodiment can operate as both a security light and an egress lighting luminaire in the event of house power interruption. The HLS 1 embodiment's optics for this application can be configured to generate an elongated illuminated path of egress 50 from the building outwardly.

Figure 10D:
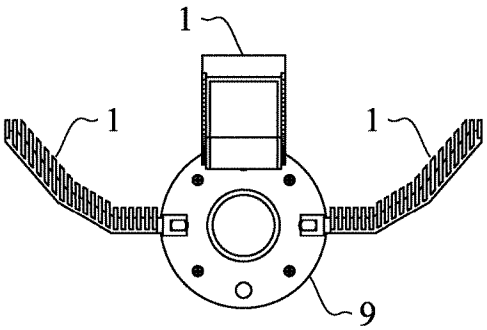

FIG. 10*d* shows an assembly similar to FIG. 10*c*. The assembly differs by showing three HLS 1 embodiments coupled to an enclosure 9 with the emitting light to surfaces to the right and left below, and a single HLS 1 embodiment at the center emitting light forward toward the surface below. This example can be used to illuminate a path of egress 50 over interior egress doors and/or as ambient night light luminaires 55.

Figure 10E:
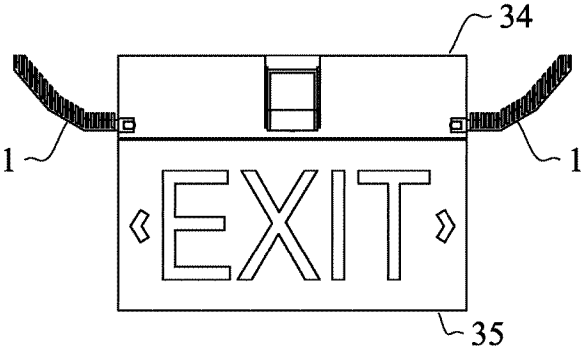

FIG. 10*e* shows a wall-mounted exit sign 35 luminaire with three detachable HLS 1 embodiments coupled to a module 34 above the face of the sign 35. As in FIG. 10*d*, the HLS 1 embodiment illuminates the egress path 50 below forming an illuminated field shaped like the letter "T". In other configurations, the path formed can resemble the letter "L" with only two embodiments, or the letter "I" with one embodiment only.

Figure 10F:
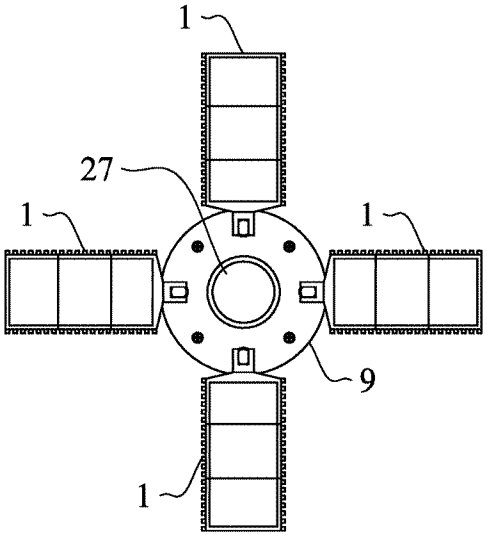

FIG. 10*f* shows a four HLS 1 embodiment wherein the embodiments are horizontally disposed at 90° to one another. The assembly couples to an enclosure 9 that can retain the lamp's driver 25 or the lamp's driver 25 and other electronic devices 26. The devices can include at least one of a camera 27, air quality/smoke sensor 32, occupancy sensor 18, mic/speaker 31, a communication device 33, and a processor 17. The processor 17 can employ AI code with self-learning capability. The camera 27 and/or other coupled sensing devices, in real time, can report the sensed event to a local and/or remote location.

Power to the enclosure 9 can be provided continuously with a microswitch turning on at least one HLS 1 embodiment, or off, only turning on in the event of house power interruption with power arriving at the enclosure 9 from at least one remote source.

Returning to the present figure, the HLS 1 embodiment of the four HLS 1 assembly forms an illuminated path of egress 50 resembling a cross pattern below the embodiment. This pendant, conduit or ceiling-mounted enclosure with a single or plurality of HLS 1 embodiments will have extensive use in buildings with medium or high mounting surfaces where an egress path of illumination 50 is code required. This innovation can eliminate the need for backup batteries 23 in locations difficult to reach, also mitigating legal battery disposal concerns. With minimal power input required, this innovation can rely on remote power, providing improved code compliant illumination at reduced construction and maintenance costs.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A heatsink light source comprising:

a unitary nonlinear profiled heatsink comprises a plurality of heat dissipating fins and at least two bisecting planar surfaces linearly disposed along a longitudinal axis of the heatsink, each of the bisecting planar surfaces are substantially flat and at least one bisecting planar surface area differs from another bisecting planar surface area;

a plurality of light sources coupled to each of the bisecting planar surfaces;

a unitary lens comprising a plurality of light source dedicated optical lenses disposed over the light sources, and an arm coupled to the heatsink to provide at least one of vertical and lateral mobility, the light sources coupled to a first bisecting planar surface of the at least two bisecting planar surfaces are configured to target different contiguously first sub-fields of illumination, the light sources coupled to a second bisecting planar surface of the at least two bisecting planar surfaces are configured to target different contiguously second sub-fields of illumination, wherein the first and the second sub-fields of illumination form a larger contiguous field of illumination that is uniformly lit and pattern controlled; and a tilt angle between each of the bisecting planar surfaces increases in relation to the larger contiguous field of illumination such that the bisecting planar surface having a highest tilt angle or highest tilt angle and surface area illuminates a farthest sub-field of the field of illumination, and each of the bisecting planar surfaces are nonaligned along the longitudinal axis of the heatsink.

2. The heatsink light source of claim 1, wherein at least two light sources coupled to a same bisecting planar surface differ from one another by at least one of: input power, a color rendering index (CRI), color temperature, a size and/or count of the light source.

3. The heatsink light source of claim 1, wherein the arm is detachable and is configured to retain an electronic device.

4. The heatsink light source of claim 1, wherein at least one of the lenses disposed over the light sources is micro/nano lens.

5. The heatsink light source of claim 1, wherein the arm is coupled to an electronic device enclosure.

6. The heatsink light source of claim 5, wherein the arm is detachable and configured to engage reciprocating receptacles.

7. A heatsink light source comprising:

a unitary nonlinear profiled heatsink comprises at least two bisecting planar surfaces linearly disposed along a longitudinal axis of the heatsink, each of the bisecting planar surfaces are substantially flat and at least one bisecting planar surface area differs from another planar surface area;

a plurality of light sources coupled to each of the bisecting planar surfaces;

a unitary lens comprising a plurality of light source dedicated optical lenses;

an arm coupled to the heatsink to provide at least one of vertical and lateral mobility;

an enclosure with a plurality of mechanical and electromechanical receptacles configured to couple to at least one of a heatsink or a heatsink and another electrical device, wherein each of the plurality of light source dedicated optical lenses is disposed above at least two of the plurality of light sources, the light sources coupled to a first bisecting planar surface of the at least two bisecting planar surfaces are configured to target different contiguously first sub-fields of illumination, the light sources coupled to a second bisecting planar surface of the at least two bisecting planar surfaces are configured to target different contiguously second sub-fields of illumination, wherein the first and the second sub-fields of illumination form a larger contiguous field of illumination that is uniformly lit and pattern controlled; and a tilt angle between each of the bisecting planar surfaces increases in relation to the larger contiguous field of illumination such that the bisecting planar surface having a highest tilt angle or highest tilt angle and surface area illuminates a farthest sub-field of the field of illumination, and each of the bisecting planar surfaces are nonaligned along the longitudinal axis of the heatsink.

8. The heatsink light source of claim 7, wherein the arm, coupled to the heatsink, employs a detachable connector that provides at least one of mechanical connectivity and electrical power connectivity to the heatsink.

9. The heatsink light source of claim 7, wherein the heatsink light source generates a uniform and controlled illumination pattern without aiming the light source.

10. The heatsink light source of claim 7, wherein overlapping light contribution from the plurality of light sources disposed on contiguous bisecting planar surfaces, uniformly illuminates the corresponding contiguous sub-fields.

11. The heatsink light source of claim 7, wherein the unitary lens disposed over at least one of bisecting planar surface comprises a plurality of light source dedicated micro/nano optical lenses.

12. The heatsink light source of claim 7, wherein at least one light source coupled to the bisecting planar surfaces differs from another light source coupled to a same bisecting planar surface by at least one of: input power, a color rendering index (CRI), color temperature, a size and/or count of the light source.

13. The heatsink light source of claim 7, wherein the field of illumination size and pattern is configured by a number of light sources coupled to an enclosure, a mounting height of the enclosure, and orientation of the light source dedicated optical lenses coupled to the heatsink.

14. A heatsink light source comprising:

a unitary nonlinear profiled heatsink comprising at least two bisecting planar surfaces linearly disposed along the longitudinal axis of the heatsink, each of the bisecting planar surfaces are substantially flat and at least one bisecting planar surface area differs from another bisecting planar surface area;

a plurality of light sources coupled to each of the bisecting planar surfaces;

a unitary lens comprising a plurality of light source dedicated lenses; and an arm coupled to the heatsink to provide at least one of vertical and lateral mobility, wherein a profile of the unitary nonlinear profiled heatsink is configured based on:

a predefined mounting height of the heatsink, a length of a horizontal path to be illuminated by the light sources, a predefined level of light, a tilt angle of the plurality of the bisecting planar surfaces, a type, a size, color, and a shape of the light sources that illuminate the horizontal sub-fields of illumination, an amount of power needed to attain the predefined light level, and the light source dedicated lens optics needed to illuminate a predefined path, a tilt angle between each of the bisecting planar surface with respect to a vertical plane increases from a first side of the heatsink to a second side of the heatsink, the first side being substantially parallel to the horizontal path to be illuminated, and each of the bisecting planar surfaces is nonaligned along the longitudinal axis of the heatsink.

15. The heatsink light source of claim 14, wherein a coupled arm provides at least one of: a vertical and a lateral rotational mobility to the heatsink.

16. The heatsink light source of claim 15, wherein the arm is detachable and is configured to retain an electronic device.

17. The heatsink light source of claim 14, wherein the arm is coupled to an enclosure that retains Internet of Things (IoT) devices.

18. The heatsink light source of claim 14, wherein the arm is configured to couple the heatsink to at least one of: an emergency and a non-emergency type luminaire.

19. The heatsink light source of claim 14, wherein the surface area and the tilt angle of the bisecting planar surface are based on at least the distance between the zone sub-fields targets and the bisecting planar surface.

20. The heatsink light source of claim 14, wherein a plurality of dedicated and specific height configured optical lenses are disposed over a corresponding plurality of light sources coupled to the bisecting planar surface.

* * * * *